US006027576A

United States Patent [19]

Schrey et al.

[11] Patent Number: 6,027,576

[45] Date of Patent: Feb. 22, 2000

[54] RARE EARTH ELEMENT-IRON-BORON PERMANENT MAGNET AND METHOD FOR THE MANUFACTURE THEREOF

[75] Inventors: Peter Schrey, Seeheim-Jugenheim; Mircea Velicescu, Waldshut, both of Germany

[73] Assignee: Vacuumschmelze GmbH, Hanau, Germany

[21] Appl. No.: 09/254,373

[22] PCT Filed: Aug. 19, 1997

[86] PCT No.: PCT/DE97/01786

§ 371 Date: Mar. 5, 1999

§ 102(e) Date: Mar. 5, 1999

[87] PCT Pub. No.: WO98/10437

PCT Pub. Date: Mar. 12, 1998

[30] Foreign Application Priority Data

Sep. 6, 1996 [DE] Germany ..... 196 36 285

[51] Int. Cl.[7] ..... H01F 1/04

[52] U.S. Cl. ..... 148/100; 148/100; 148/302

[58] Field of Search ..... 148/100, 302

[56] References Cited

U.S. PATENT DOCUMENTS 5,405,455 4/1995 Kusunoki et al. ..... 148/103

5,447,578 9/1995 Ozaki et al. ..... 148/302

5,482,575 1/1996 Barzasi et al. ..... 148/302

FOREIGN PATENT DOCUMENTS 0 249 973 11/1991 European Pat. Off. .

0 517 179 12/1992 European Pat. Off. .

0 651 401 5/1995 European Pat. Off. .

*Primary Examiner*—Ngoclan Mai

*Attorney, Agent, or Firm*—Hill & Simpson

[57] ABSTRACT

In a method for manufacturing a permanent magnet, a powder of a magnetic base alloy and powders of first and second binder alloys are mixed. The magnetic base alloy has a general formula $SE_2T_{14}B$, wherein SE is at least one rare earth element, including Y, and T is Fe or a combination of Fe and Co, wherein Co does not exceed 40 wt % of the combination of Fe and Co. Each of the first and second binder alloys has a general formula $SE_aFe_bCo_cB_dGa_e$, wherein $15<a<40$, $0<b\leqq 80$, $5\leqq c\leqq 85$, $0<d\leqq 20$, $0<e\leqq 20$, and $a+b+c+d+e=100$, and wherein the second binder alloy contains approximately 2.5 wt % fewer rare earth elements and approximately 1.5 wt % less gallium compared to the first binder alloy. The base alloy and the binder alloys are mixed in a weight ratio of base alloy to binder alloys between 99:1 and 90:10, and is subsequently compressed and sintered in a vacuum and/or in an inert gas atmosphere.

2 Claims, 1 Drawing Sheet

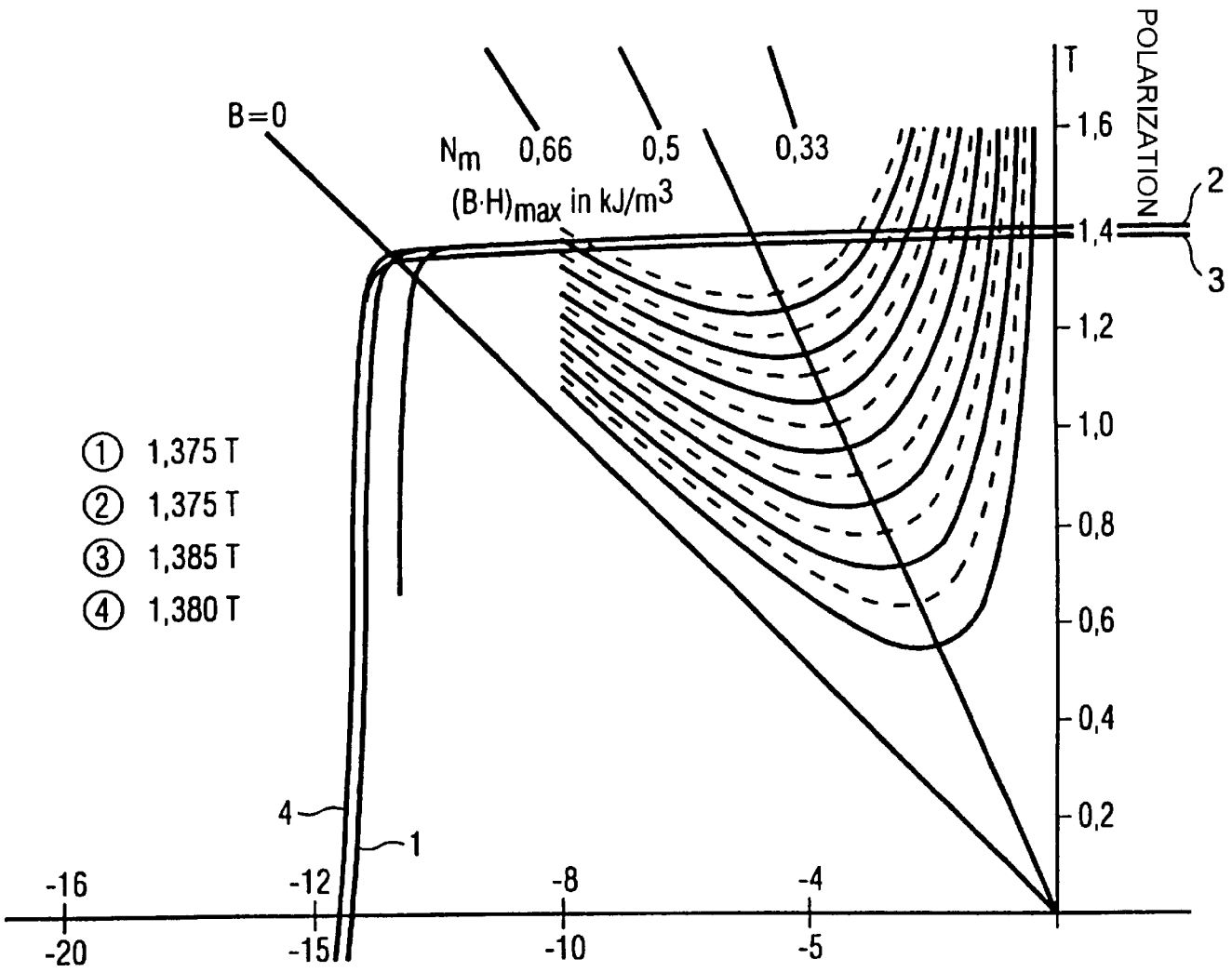
POLARIZATION
T
1,6
1,4
1,2
1,0
0,8
0,6
0,4
0,2
2
3
0,33
0,5
0,66
$N_m$
$(B \cdot H)_{max}$ in kJ/m$^3$
B=0
1
4
-4
-5
-8
-10
-12
-15
-16
-20
① 1,375 T
② 1,375 T
③ 1,385 T
④ 1,380 T

RARE EARTH ELEMENT-IRON-BORON PERMANENT MAGNET AND METHOD FOR THE MANUFACTURE THEREOF

BACKGROUND OF THE INVENTION

1. Field of the Invention

The present invention is directed to a permanent magnet of the type SE-Fe-B that has the tetragonal phase $SE_2Fe_{14}B$ as the principal phase, wherein SE is at least one rare earth element, including Y.

2. Description of the Prior Art A magnet of the above general type is disclosed, for example, in European Application 0 124 655 and in U.S. Pat. No. 5,230,751 that corresponds therewith. Magnets of the type SE-Fe-B exhibit the highest energy densities currently available. SE-Fe-B magnets manufactured by powder metallurgy contain approximately 90% of the hard-magnetic principal phase $SE_2Fe_{14}B$.

U.S. Pat. No. 5,447,578 also discloses SE-Fe-B magnets that contain SE-Fe-Co-B-Ga phases as admixtures.

One usually proceeds such in the manufacture of such SE-Fe-B magnets by mixing a SE-Fe-B base alloy with the a composition close to the $SE_2Fe_{14}B$ phase and a binder alloy with a lower melting temperature. The goal is to set the structure of the SE-Fe-B sintered magnets of $SE_2Fe_{14}B$ base alloys with inter-granular binders, while using optimally little binder alloy.

European Application 0 517 179 proposes the employment of binder alloys having the composition $Pr20Dy_{10}Co_{40}B_6Ga_4Fe_{rest}$ (in weight percent, this is Pr≈35, Dy≈20, Co≈28, B≈0.77, Ga≈3.5).

The special characteristic of this $Pr20Dy_{10}Co_{40}B_6Ga_4Fe_{bal}$ binder alloy is that it is composed of four inter-metallic phases. SEM investigations have documented that all four existing principal phases contain B and Ga. These, namely, are phases of the types:

$SE_5(Co, Ga)_3$ $SE(Co[sic], Fe, Ga)_2$, $SE(Co, Fe, Ga)_3$ $SE(Co, Fe, Ga)_4Bx$.

The melting temperatures of the phases lie at approximately 560° C., 980° C., 1060° C. and, respectively, 1080° C. The phase ⅓ and ¼ boride in fact have relatively high melting temperatures, but it is important that these lie just below the sintering temperature or, respectively, that they become molten at the sintering temperature. The phases ½, ⅓ and the ¼ boride are ferromagnetic or ferrimagnetic with Curie temperatures of 110° C., 340° C. and, respectively, 375° C.

It has now turned out that the proportion of this binder alloy in the mixture of the base alloy must lie within 7–10 weight %. In this mixing range, sinter densities of approximately $\rho>7.55$ g/cm$^3$ are achieved only at sintering temperatures above 1090° C. These sinter densities roughly correspond to 99% of the theoretical density. Outside this mixing range, the sinterability and, thus, the remanence that can be achieved are considerably influenced. The grain growth is highly activated in the magnets with a proportion of this binder alloy of more than 10 weight %, but the pores are not closed. The consequence is the formation of a structure with anomalously large grains (>50 $\mu$m) and with high porosity as well as with low sinter densities. Given lower proportions of binder alloy, the amount of the fluid phase is accordingly not adequate for the densification.

SUMMARY OF THE INVENTION

It is an object of the present invention to provide a powder-metallurgical manufacturing method for permanent magnets of the SE-Fe-B type that exhibits an enhanced sinterability compared to the known methods as well as a very good remanence.

The object is inventively achieved by a method that comprises the following steps:

$a_1$) a powder of a base alloy of the general formula $$SE_2T_{14}B,$$

wherein SE is at least one rare earth element, including Y, and T is Fe or a combination of Fe and Co, wherein the Co part does not exceed 40 weight % of the combination of Fe and Co, $a_2$) and a powder of a first binder alloy of the general formula $$SE_aFe_bCo_cB_dGa_e$$

and a powder of a second binder alloy of the general formula $$SE_2Fe_bCo_cB_dGa_e$$

wherein SE is at least one rare earth element, including Y, with $15<a<40$, $0<b\leqq 80$, $5\leqq c\leqq 85$, $0<d\leqq 20$, $0<e\leqq 20$ under the condition $a+b+c+d+e=100$, whereby the second binder alloy contains approximately 2.5 weight % fewer rare earth elements and approximately 1.5 weight % less gallium compared to the first binder alloy, are mixed in a weight ratio of base alloy to binder alloys of 99:1 to 90:10;

b) the mixture is compressed and, subsequently, c) is sintered in a vacuum and/or in an inert gas atmosphere.

It has been shown that permanent magnets manufactured in this way exhibit very high remanences, and that the proportion of binder alloy compared to the proportion of the base alloy can be reduced to below 7 weight %. Further, the additional gallium-containing phase of the binder alloy exhibits especially good wetting properties.

DESCRIPTION OF THE DRAWINGS

The single FIGURE shows typical demagnetization curves for magnets manufactured in accordance with the inventive method and having the inventive composition.

DESCRIPTION OF THE PREFERRED EMBODIMENTS

The invention is explained in greater detail below on the basis of the exemplary embodiments and the FIGURE. A $Nd_2Fe_{14}B$ base alloy (Table 1a) and two binder alloys (Table 1b) with the following compositions were employed for the investigation:

TABLE 1a

| | Composition (weight %) | | | | | | |
|---|---|---|---|---|---|---|---|
| Melt | Nd | Pr | Dy | SE | B | Al | Fe |
| SV 94/84 | 28.1 | 0.08 | <0.01 | 28.2 | 1.01 | 0.03 | Bal. |

TABLE 1b

| | Ga Concentration | | Composition (weight %) | | | | | |
|---|---|---|---|---|---|---|---|---|
| Melt | (At. %) | (Wt. %) | Pr | Dy | Co | B | Ga | Fe |
| SV 94/86 | 3.1 | 2.65 | 36.3 | 20.5 | 25.1 | 0.77 | 2.65 | Bal. |
| SV 94/108 | 1 | ~1 | 33.85 | 19.6 | 28.25 | 0.75 | 1.05 | Bal. |

The following mixtures were prepared from coarse powders of these alloys.

TABLE 2

| Mixture | G.L. (SV 94/84) (Wt. %) | B.L. (SV 94/86) (Wt. %) | B.L. (SV 94/108) (Wt. %) |
|---|---|---|---|
| 295/1 | 90 | 10 | — |
| 295/2 | 90 | 6.66 | 3.33 |
| 295/3 | 90 | 3.33 | 6.66 |
| 295/4 | 90 | — | 10 |

The calculated composition of the manufactured magnets then yield: Composition in Weight %

| SE | Dy | Pr | B | Co | Ga | Fe |
|---|---|---|---|---|---|---|
| 31.05 | 2.05 | 3.65 | 0.986 | 2.51 | 0.265 | Bal. |
| 30.9 | 2.6 | 3.55 | 0.985 | 2.6 | 0.21 | Bal. |
| 30.8 | 1.97 | 3.65 | 0.985 | 2.7 | 0.155 | Bal. |
| 30.7 | 1.96 | 3.4 | 0.984 | 2.8 | 0.105 | Bal. |

The mixtures were finely ground in a planetary ball mill or 120 minutes; the average particle size of the fine powder achieved 2.4 $\mu$m. Anisotropic, isostatically pressed magnets were manufactured from the fine powders. They were sintered to densities of $\rho>7.50$ g/cm$^3$ and subsequently tempered.

The magnets were sintered as follows:

1090° C./34 (1 h vacuum+2 h in argon)

1070° C./34 (1 h vacuum+2 h in argon)

1060° C./34 (1 h vacuum+2 h in argon)

Extremely high sinter densities of $\rho>99\%$ were already measured at sintering temperatures of 1060° C.

The typical demagnetization curves of the magnets are shown in the FIGURE. At room temperature, the magnets achieve remanences of 1.39 to 1.41 T and coercive field strengths $H_{cJ}>14$ kOe. The magnets achieve a very high alignment of the grains (98–98.6%)

Although modifications and changes may be suggested by those skilled in the art, it is the intention of the inventors to embody within the patent warranted hereon all changes and modifications as reasonably and properly come within the scope of their contribution to the art.

We claim as our invention:

1. A method for manufacturing a permanent magnet, comprising the steps of:

a) mixing a powder of a magnetic base alloy of the general formula $$SE_2T_{14}B,$$

wherein SE is at least one rare earth element, including Y, and T is selected from the group consisting of Fe and a combination of Fe and Co, wherein Co does not exceed 40 weight % of the combination of Fe and Co, and a powder of a first binder alloy of a general formula $$SE_aFe_bCo_cB_dGa_e$$

and a powder of a second binder alloy of a general formula $$SE_aFe_bCo_cB_dGa_e$$

wherein $15<a<40$, $0<b\leqq 80$, $5\leqq c\leqq 85$, $0<d\leqq 20$, $0<e\leqq 20$ and $a+b+c+d+e=100$, and wherein the second binder alloy contains approximately 2.5 weight % fewer rare earth elements and approximately 1.5 weight % less gallium compared to the first binder alloy, in a weight ratio of base alloy to binder alloys between 99:1 to 90:10 to obtain a mixture;

b) compressing the mixture to obtain a compressed mixture; and c) sintering the compressed mixture in an environment selected from the group consisting of a vacuum and an inert gas atmosphere.

2. A method according to claim 1, wherein the step of mixing comprises mixing said base alloy and said binder alloys in a weight ratio of base alloy to binder alloys between 99:1 and 93:7.

* * * * *